US007347403B2

(12) United States Patent
Belcourt et al.

(10) Patent No.: US 7,347,403 B2
(45) Date of Patent: Mar. 25, 2008

(54) ICE SCREW HAVING BREAKAWAY OR FLEXING CRANK HANDLE

(75) Inventors: William R. Belcourt, Salt Lake City, UT (US); Charles G. Brainerd, Sandy, UT (US)

(73) Assignee: Black Diamond Equipment, Ltd. Inc., Salt Lake City, UT (US)

( * ) Notice: Subject to any disclaimer, the term of this patent is extended or adjusted under 35 U.S.C. 154(b) by 5 days.

(21) Appl. No.: 10/660,212

(22) Filed: Sep. 11, 2003

(65) Prior Publication Data

US 2005/0056747 A1 Mar. 17, 2005

(51) Int. Cl.
*A47F 5/08* (2006.01)

(52) U.S. Cl. ..... 248/231.9; 411/400; 248/925

(58) Field of Classification Search ..... 248/231.9, 248/925; 411/400, 401, 409; 74/545; 7/168
See application file for complete search history.

(56) References Cited

U.S. PATENT DOCUMENTS 1,111,489 A * 9/1914 Palmer ..... 242/396.1
5,118,061 A * 6/1992 Byrne et al. ..... 248/231.9
5,528,803 A * 6/1996 Frisoli ..... 24/712
5,782,442 A * 7/1998 Kwak et al. ..... 248/231.9
6,068,226 A * 5/2000 Anders ..... 248/231.91
6,505,799 B1 1/2003 Bercaw et al. ..... 248/231.9
6,607,340 B2 * 8/2003 Petzl et al. ..... 411/400
2002/0074443 A1 6/2002 Murdock

* cited by examiner

*Primary Examiner*—A. Joseph Wujciak, III
(74) *Attorney, Agent, or Firm*—Thorpe North & Western LLP

(57) ABSTRACT

The present invention features an ice screw for use in ice climbing, wherein the ice screw comprises: a hollow shaft having a plurality of screw threads formed thereon for securing the ice screw to a body of ice; a hanger coupled to the hollow shaft for receiving a carabiner and supporting a climber; and a flexing crank handle coupled to an aperture or eye formed within the hanger, wherein the flexing crank handle functions as a crank arm for screwing the ice screw into the body of ice, and wherein the flexing crank arm displaces or flexes from a resting, cranking position to a plurality of flexed positions in response to a load induced thereon. The flexing crank handle reduces the chance for cross-loading of an attached carabiner due to the existence of a crank handle without requiring any manual manipulation (e.g., folding) of the crank handle once the ice screw is inserted into the ice structure.

32 Claims, 15 Drawing Sheets

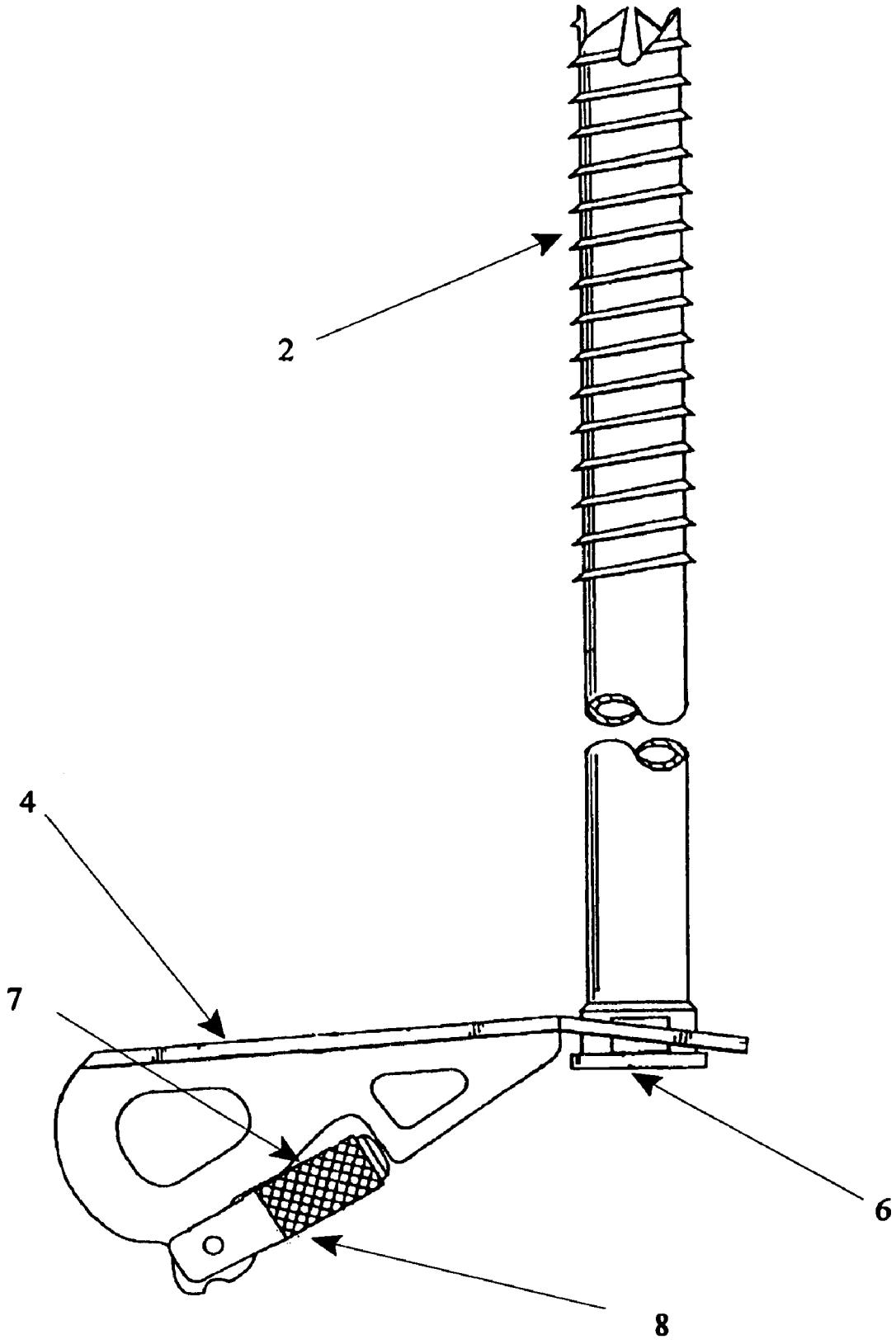
FIGURE 1-A

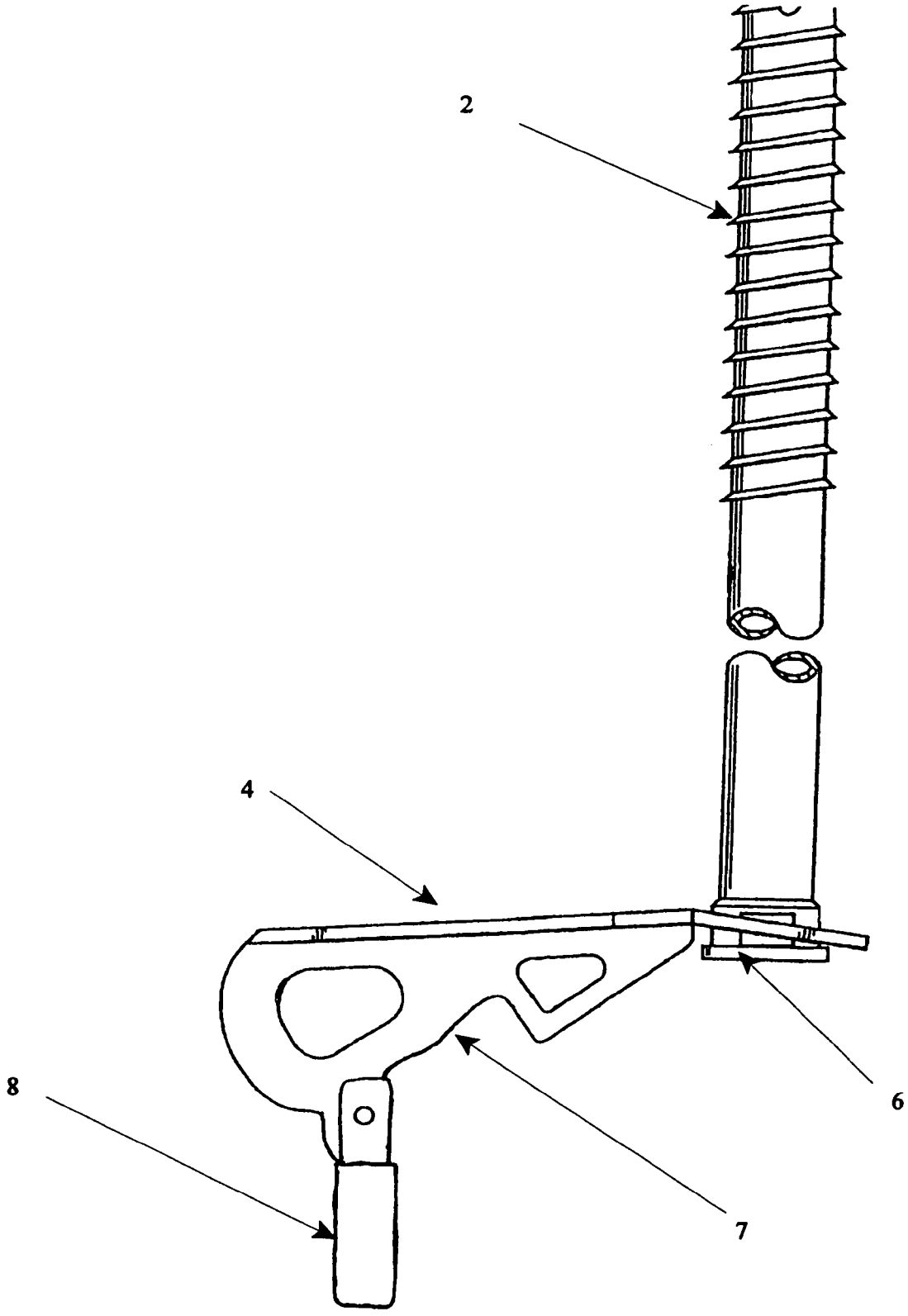
FIGURE 1-B

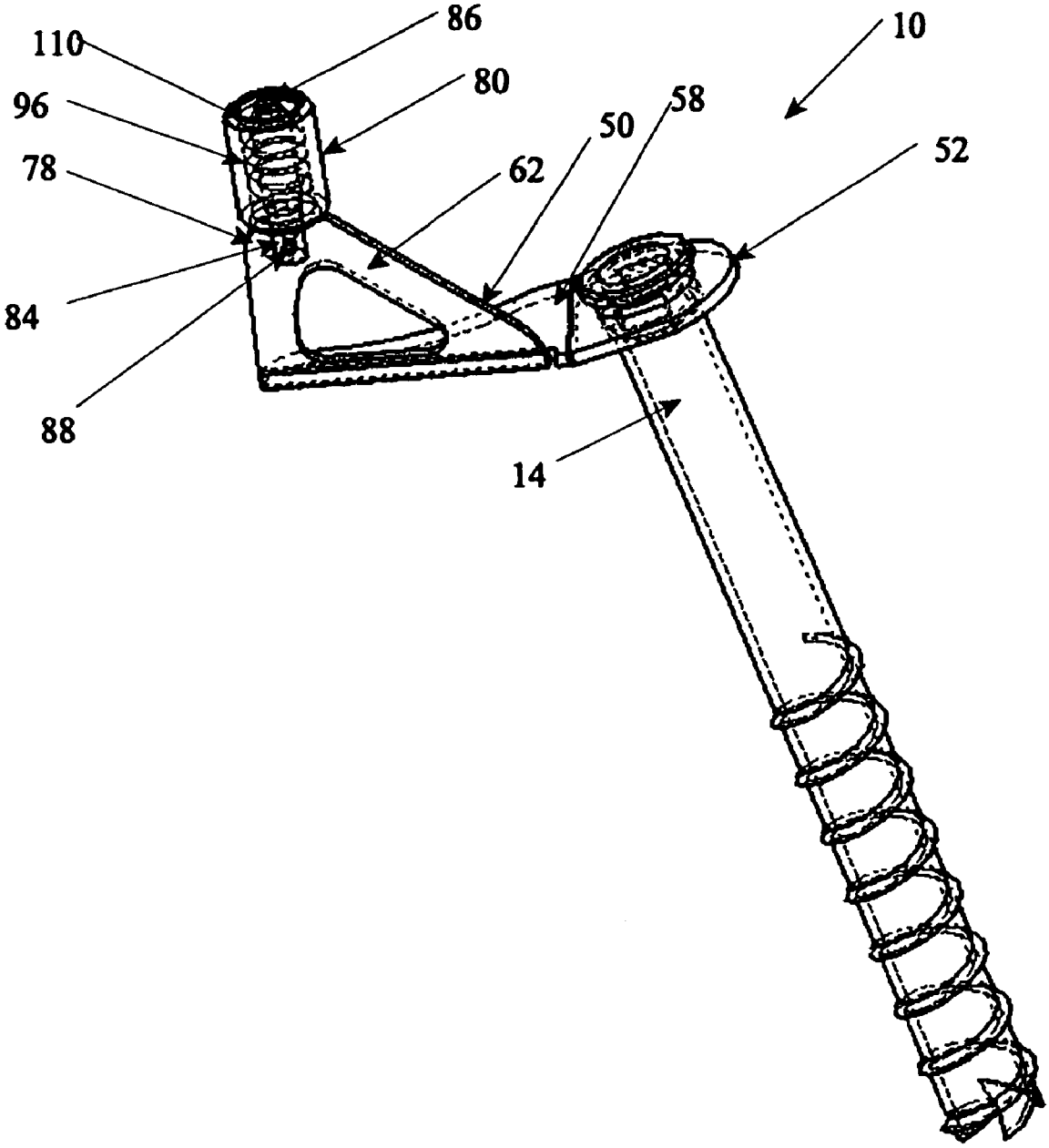
FIGURE 5-A

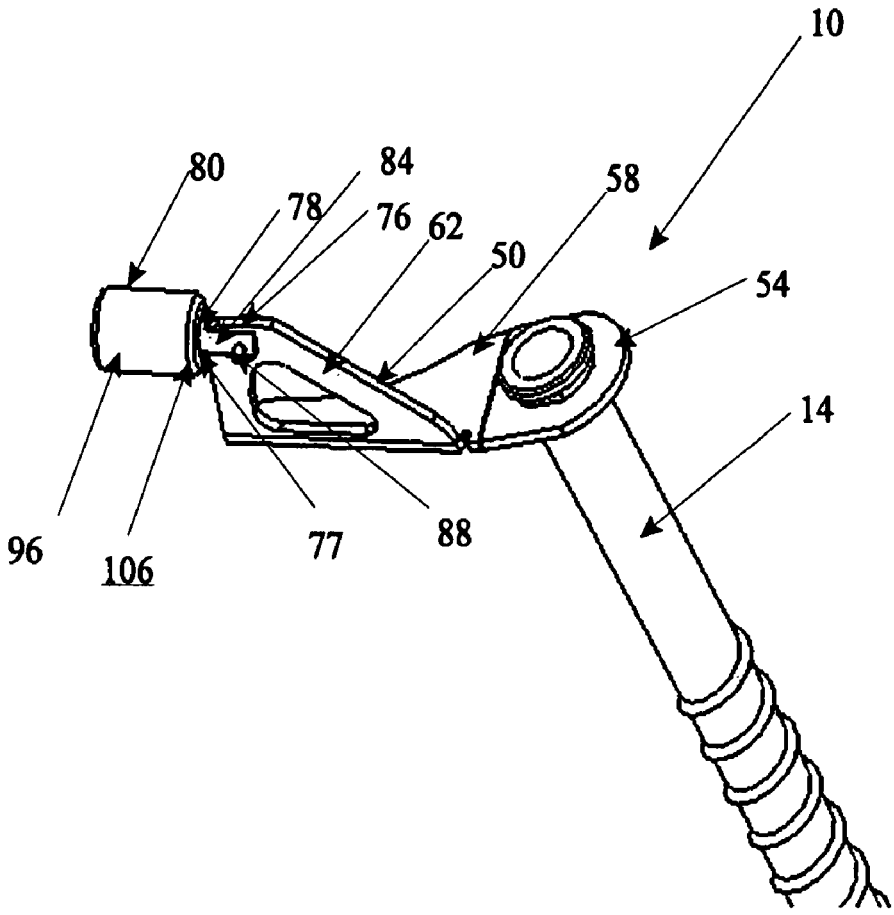
FIGURE 5 -B

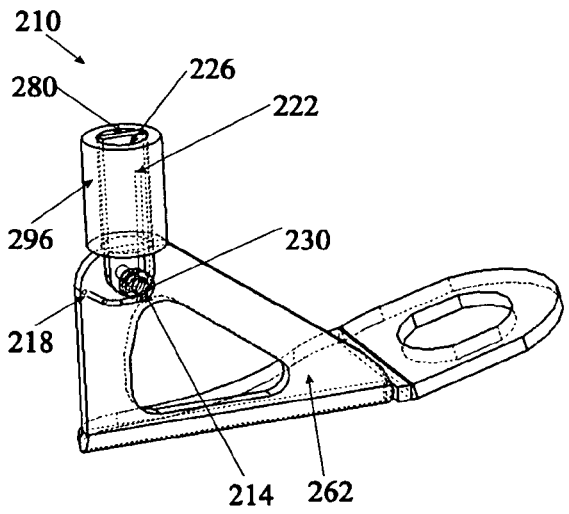
FIGURE 9-A
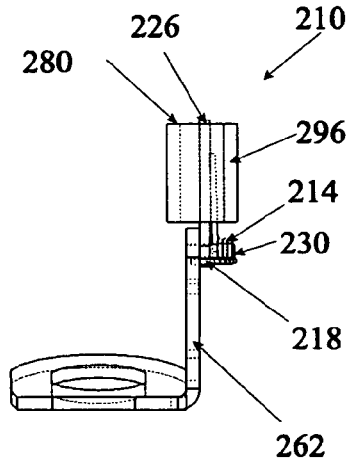
FIGURE 9-B

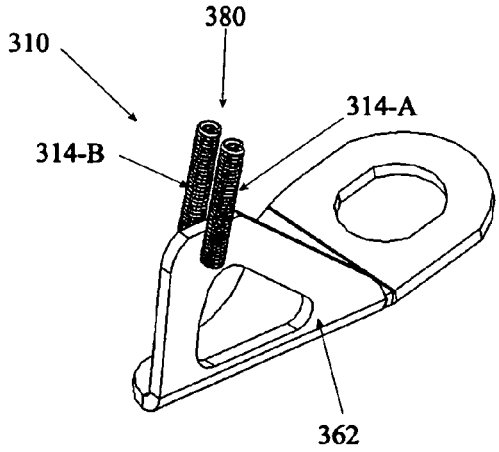
FIGURE 10-A
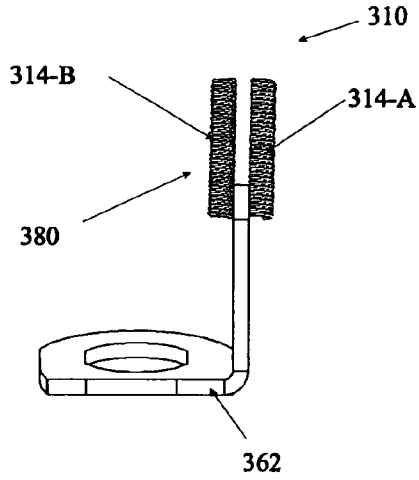
FIGURE 10-B

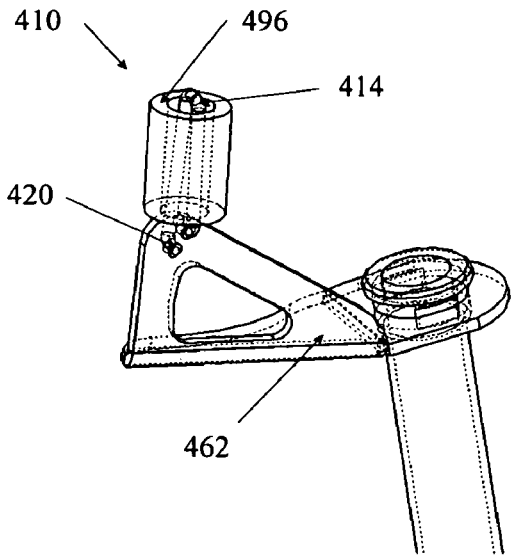
FIGURE 11-A
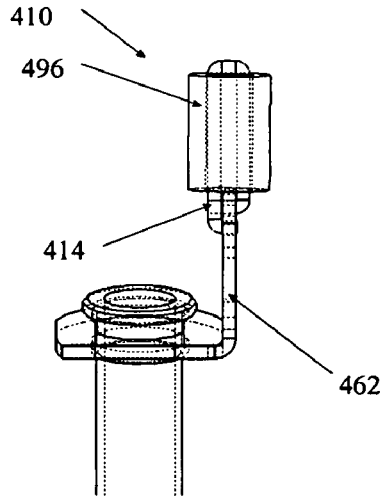
FIGURE 11-B

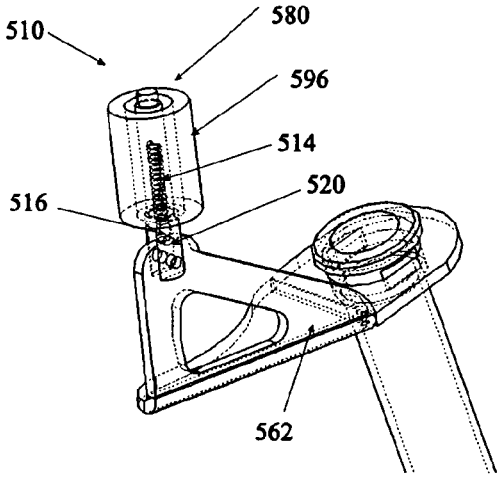
FIGURE 12-A
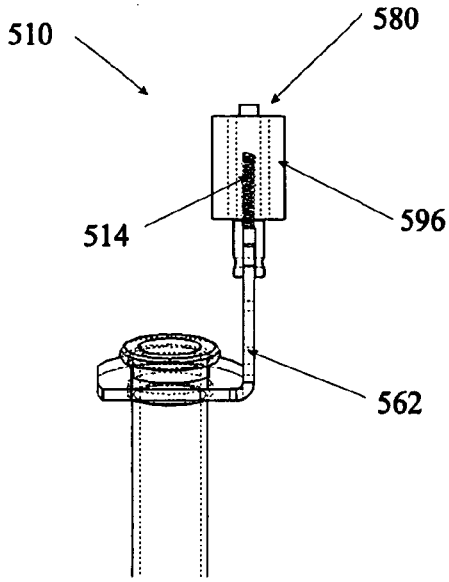
FIGURE 12-B

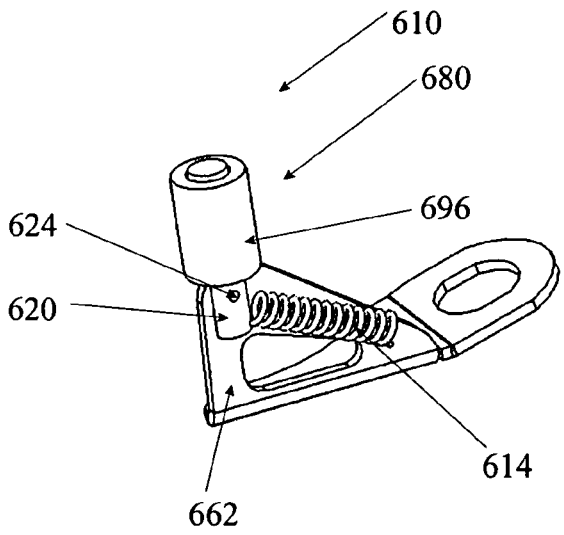
FIGURE 13-A
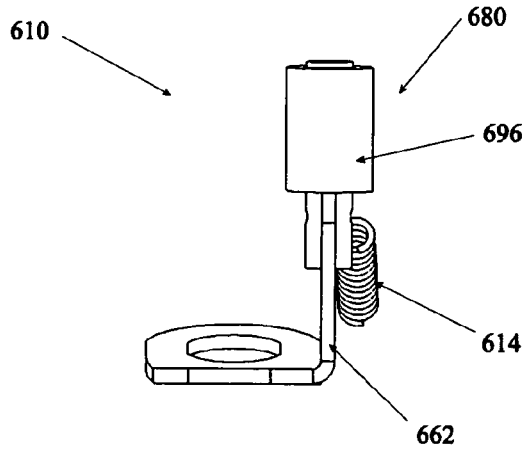
FIGURE 13-B

ICE SCREW HAVING BREAKAWAY OR FLEXING CRANK HANDLE

BACKGROUND

1. Field of the Invention

The present invention relates to winter climbing gear and/or equipment, and particularly, to ice screws that are inserted or screwed into a body of ice for the purpose of providing a climber means whereby he/she may couple or secure a support structure, such as a carabiner, thereto, for support and security while climbing a snow/ice packed mountain. Even more particularly, the present invention relates to a flexing or breakaway crank handle attached to the hanger of an ice screw that functions to facilitate more efficient screwing of the ice screw into the body of ice, as well as to facilitate the repositioning of a carabiner, any ropes or additional carabiners attached in-line, slings, etc. or allow each to be repositioned, to a proper or correct load bearing position if the carabiner initially is improperly loaded.

2. Background of the Invention and Related Art

Mountain climbing, and particularly winter or alpine climbing, has evolved into a highly technical sport with climbers utilizing much more sophisticated equipment or gear to ascend a mountain of snow and ice. Included in the winter climber's gear are several ice screws having a hanger or hanger portion thereon, wherein the ice screws are inserted or screwed into a body of ice leaving the hanger portion exposed for the purpose of providing means to couple a carabiner thereto and to support the climber on the mountain or icy face.

Several different designs of ice screws exist in the market. As ice screws are required to be inserted several inches into the ice to provide adequate support for the climber, the advent of a cranking arm or crank handle has been introduced to facilitate the insertion and screwing of the threaded shaft into the ice. The climber grasps the cranking handle and uses it as leverage to create a greater amount of force used to drive the ice screw into the ice. Different types of cranking arms exist and are utilized on different types of ice screws, some of the most common being described below.

One of the problems associated with ice screws, and particularly ice screws utilizing a crank handle, is cross-loading. Cross-loading is defined as the situation when a carabiner is operational in a load sharing arrangement, but there is a component of force acting across the spine of the carabiner. In the case of an ice screw having a crank handle, this handle typically tends to protrude out from the hanger a substantial distance, enough to provide an obstruction to a carabiner, or to provide means by which the carabiner may get caught, thus causing the carabiner to be arranged in an abnormal, unsafe orientation or arrangement. If cross-loading occurs, the strength of the carabiner is reduced dramatically, thus increasing the potential for failure of the carabiner and overall risk to the climber. Cross-loading of a carabiner is a common problem in climbing, but even more so when there is a component on the device the carabiner is being coupled to that impedes the normal operation and movement of the carabiner, such as a crank handle.

As indicated, in the case of winter or alpine climbing, ice screws have been developed to comprise crank handles to make the task of screwing or driving the ice screw into a body of ice much easier and much more efficient by making the cranking process much easier for the climber. However, to be effective and to provide an efficient crank arm these crank handles must protrude a substantial distance from the hanger component of the ice screw. As a result, the carabiners coupled to the hanger have a tendency to get caught or hung up on the crank handles, thus contributing to the problem of cross-loading and the carabiner is at a fraction of its strength, unless it can free itself or is caused to disengage the crank handle. Several prior art designs have addressed the difficulties associated with screwing ice screws into a body of ice, as well as the problems associated with cross-loading of carabiners due to the addition of a crank handle.

Referring to FIGS. 1-A and 1-B, U.S. Pat. No. 5,782,442 to Kwak et al. discloses an ice screw having a hollow tubular shaft with external screw threads formed on the shaft to form a threaded screw 2 and a hanger 4 attached to threaded screw 2. Hanger 4 has an eye for clipping on a carabiner. A foldable crank handle 8 is pivotally attached to hanger 4 to pivot between a folded position (FIG. 1-A) and a crank position (FIG. 1-B). In the crank position, foldable crank handle 8 extends from hanger 8 for grasping to rotate and thus rotate the shaft. In the folded position, the handle folds into a recess 7 formed in hanger 4. In the crank position, hanger 4 serves as a lever arm or crank arm for handle 8. Although this design eliminates the problem of cross-loading because the crank handle is able to fold out of the way, there are several other problems inherent in this design. First, hanger 4 must be larger to accommodate a recessed portion that crank handle 8 may fold into. This increases not only the overall weight of the ice screw in a weight conscious sport, but also makes hanger 4 more bulky and cumbersome. Second, since crank handle 8 is manually actuated, the spring or biasing member contained within the crank handle cannot be too stiff. If it were too stiff, the handle would not fold easily, or worse yet, would require an additional tool to fold it into recess 7. As such, since it is desirable to manually fold crank handle 8, the spring must be comprise an appropriate spring constant and associated stiffness. This creates a significant problem when cranking crank handle 8. As the climber inserts the ice screw into the ice and begins cranking, the crank handle will have a tendency to fold or pivot at certain crank positions due to the force exerted on the crank handle by the climber and the lack of a sufficient spring constant to keep the crank handle from inadvertently folding during the cranking process.

With reference to FIG. 2, shown is another prior art ice screw comprising a crank handle 8. This crank handle, while possessive of good cranking characteristics, is extremely bulky and unnecessarily large and requires the climber to physically manipulate the crank handle to crank the ice screw and also to fold it out of the way once the ice screw is inserted. In addition, crank handle 8 tends to get caught on several items, including clothing, rope, and other climbing gear because of its size.

Accordingly, what is needed is an ice screw having a crank handle for facilitating cranking ease and efficiency and that does not allow undue folding during the cranking process, as well as a cranking handle that concurrently reduces or eliminates the problem of cross-loading.

SUMMARY AND OBJECTS OF THE INVENTION

The present invention seeks to improve upon prior art ice screws and to eliminate many of the problems associated with prior art designs, as discussed above.

Therefore, it is an object of some embodiments of the present invention to provide an ice screw having a crank handle that functions as a crank arm for screwing an ice screw into a body of ice.

It is another object of some embodiments of the present invention to provide a substantially stationary crank handle that does not require manual manipulation to move the crank arm out of the way after the cranking process is completed.

It is another object of some embodiments of the present invention to provide an ice screw that does not contribute to cross-loading of a coupled support device, such as a carabiner, but that instead functions to reduce and/or eliminate the problem of cross-loading with respect to ice screws.

In accordance with the invention as embodied and broadly described herein, the present invention features an ice screw for use in ice climbing, wherein the ice screw comprises: a hollow shaft having a plurality of screw threads formed thereon for securing the ice screw to a body of ice; a hanger coupled to the hollow shaft for receiving a carabiner and supporting a climber; and a flexing crank handle coupled to the hanger in a substantially stationary manner, the flexing crank handle functioning as a crank arm for screwing the ice screw into the body of ice, the flexing crank arm also displacing or flexing from a resting, cranking position to one or a plurality of flexed positions in response to a load induced thereon.

In one exemplary embodiment, the flexing crank handle comprises a mechanism for facilitating displacement and flexing of the flexing crank handle, wherein the mechanism comprises an attachment means for attaching the flexing crank handle to the hanger, and a flexing member operable with the attachment means, wherein the flexing member allows the flexing crank handle to flex and displace in response to an induced load. The mechanism may further comprise a sleeve, and preferably a rotating sleeve, that is coupled to the flexing member that functions as a grasping handle for the user. The attachment means is preferably a rigid rod that pivots about a pivot point as discussed below.

In an exemplary embodiment, the flexing member comprises a compression spring supported within the sleeve and pre-loaded using a plunger attached to the attachment means and that fits within the sleeve. The compression spring has a pre-determined stiffness for responding to a given load.

In another exemplary embodiment, the flexing member comprises a spiral spring.

In yet another exemplary embodiment, the flexing member comprises complimentary solid height coil springs attached opposite one another on the hanger. Or, alternatively, the flexing member comprises a single solid height coil spring attached within a recess formed in the hanger.

In still another exemplary embodiment, the flexing member comprises a wire torsion spring.

In still another exemplary embodiment, the flexing member comprises an internal coil spring.

In still another exemplary embodiment, the flexing crank handle comprises a flexible member attached to the hanger, wherein the flexing member is selected from the group consisting of a string, a cable, a semi-rigid material, or any other similar flexing element.

In one exemplary embodiment, and particularly the embodiment wherein a mechanism is utilized, the flexing crank handle discussed above is caused to flex about or along a pre-defined or pre-determined flex boundary defined by the structure of the hanger (e.g., the formed edge of the hanger) to which the flexing crank handle is attached.

In another exemplary embodiment, the flexing crank handle comprises a flexing member that attaches at one end to the hanger of the ice screw, but does not require the existence of a flex boundary.

In each of the embodiments identified above, the flexing crank handle reduces the chance for cross-loading of an attached carabiner due to the existence of the crank handle without requiring any manual manipulation (e.g., folding) of the crank handle once the ice screw is inserted into the ice structure. In its broadest sense, the present invention is intended to be operable with all types of ice screws. In addition, it is intended that the present invention is to cover all types of crank handles that are capable of flexing in response to a load, such as the load induced upon the crank handle if a carabiner is cross-loaded, as well as the various types of mechanisms or structures providing such a flexing function.

The present invention further features a method for correcting cross-loading of a carabiner coupled to an ice screw inserted into a body of ice, or a method for securing a carabiner to an ice screw, or a method for securing an ice screw to a body of ice. The method comprises the steps of securing or screwing an ice screw into a body of ice so that, in the event a coupled carabiner becomes cross-loaded, the flexing crank handle will displace and/or flex allowing the carabiner to disengage and free itself from the flexing crank handle under the load applied to the carabiner, thus facilitating proper positioning and operation of the carabiner.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are riot therefore to be considered limiting of its scope, the invention will be described and explained with additional specificity and detail through the use of the accompanying drawings in which:

FIG. 1-A illustrates a prior art ice screw having a foldable crank handle shown in a folded position;

FIG. 1-B illustrates the prior art ice screw of FIG. 1-A, wherein the foldable crank handle is shown in an extended, cranking position;

FIG. 5-A illustrates a perspective view of the ice screw illustrated in FIG. 3, wherein the flexing crank handle is shown in its rested, cranking position;

FIG. 5-B illustrates a perspective view of the ice screw illustrated in FIG. 3, wherein the flexing crank handle is shown is a flexing position along the flex boundary defined by the edge of the hanger;

FIG. 9-A illustrates a perspective view of an exemplary embodiment of a flexing member in the form of a spiral spring;

FIG. 9-B illustrates a side view of the embodiment shown in FIG. 9-A;

FIG. 10-A illustrates a perspective view of an exemplary embodiment of a flexing member in the form of a solid height coil spring assembly;

FIG. 10-B illustrates a side view of the embodiment shown in FIG. 10-A;

FIG. 11-A illustrates a perspective view of an exemplary embodiment of a flexing member in the form of a wire torsion spring;

FIG. 11-B illustrates a side view of the embodiment shown in FIG. 11-A;

FIG. 12-A illustrates a perspective view of an exemplary embodiment of a flexing member in the form of a internal coil spring or a compression spring that works in conjunction with a flex boundary having a detent in the hanger;

FIG. 12-B illustrates a side view of the embodiment shown in FIG. 12-A;

FIG. 13-A illustrates a perspective view of an exemplary embodiment of a flexing member in the form of a spiral spring; and FIG. 13-B illustrates a side view of the embodiment shown in FIG. 13-A.

DETAILED DESCRIPTION OF THE PREFERRED EMBODIMENTS

It will be readily understood that the components of the present invention as generally described and illustrated in the figures herein, could be arranged and designed in a wide variety of different configurations. Thus, the following more detailed description of the embodiments of the system and method of the present invention, and represented in FIGS. 1 through 13-B, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention describes a method and system for coupling a carabiner to an ice screw and for reducing or eliminating existing or potential cross-loading of the carabiner, wherein the ice screw comprises a flexing crank handle that functions as a crank arm for the ice screw.

Figure 2:
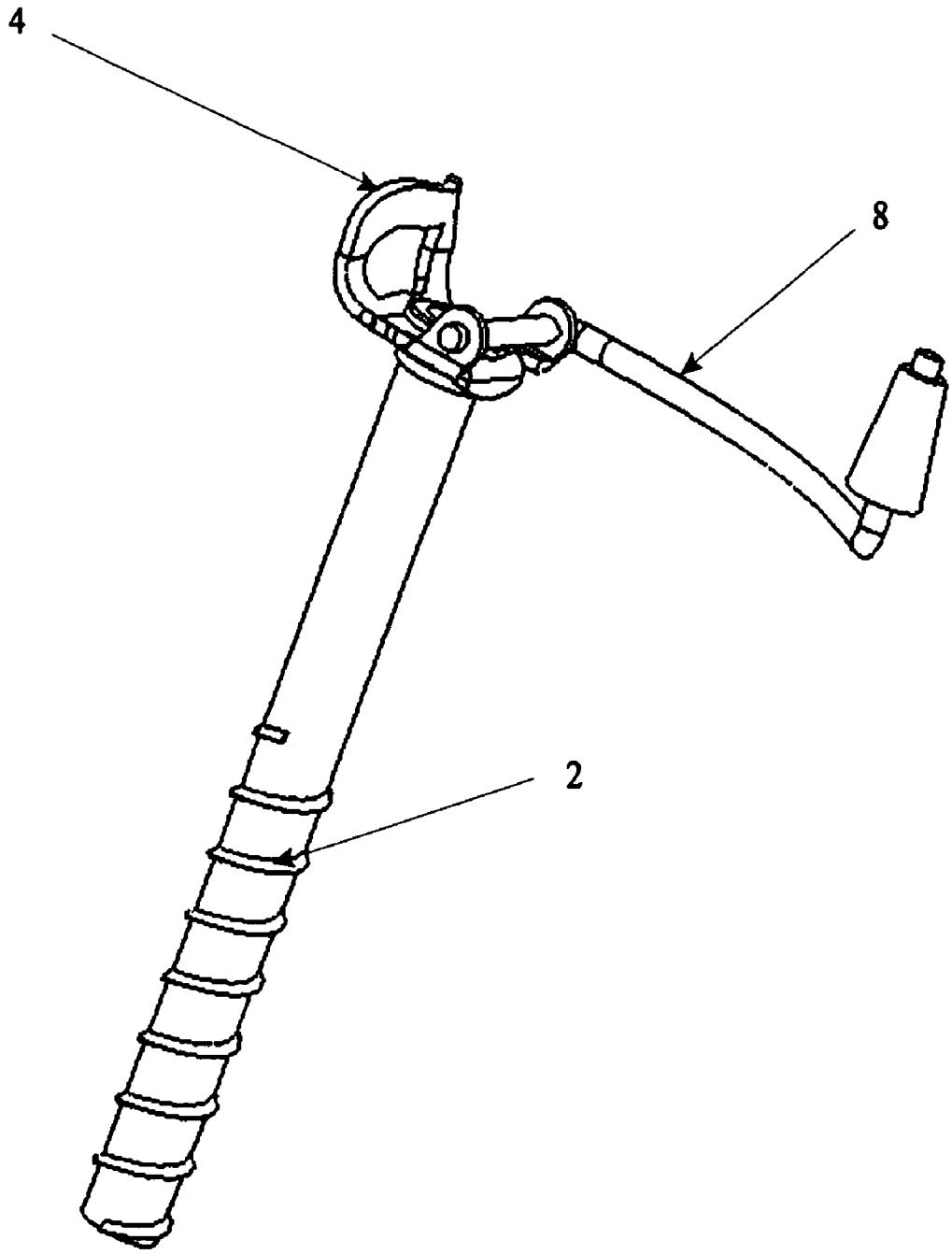
FIG. 2 illustrates another prior art ice screw having a folding crank handle.
Figure 3:
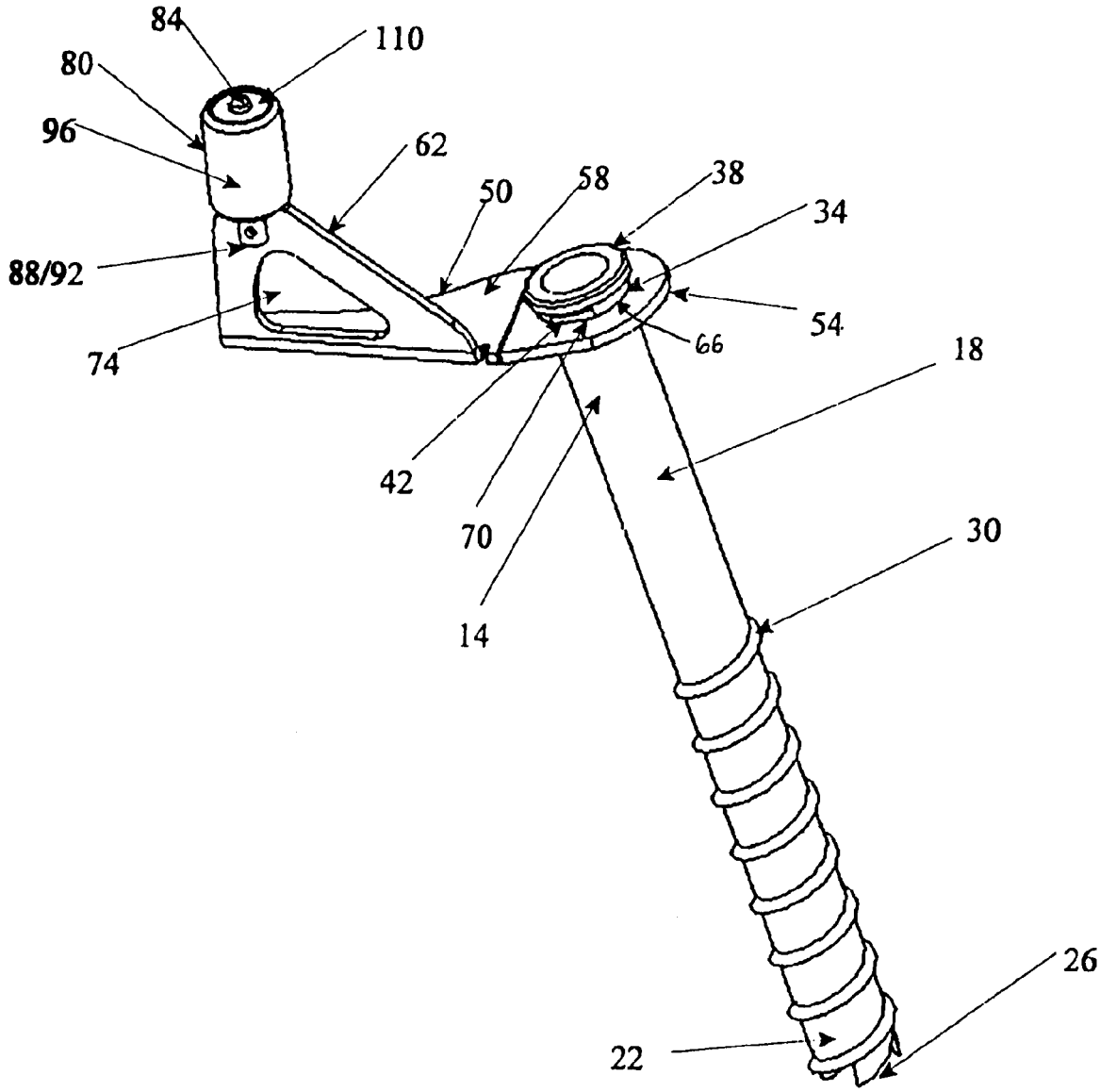
FIG. 3 illustrates a perspective view of the present invention ice screw comprising a flexing crank handle according to one exemplary embodiment of the present invention.
Figure 4:
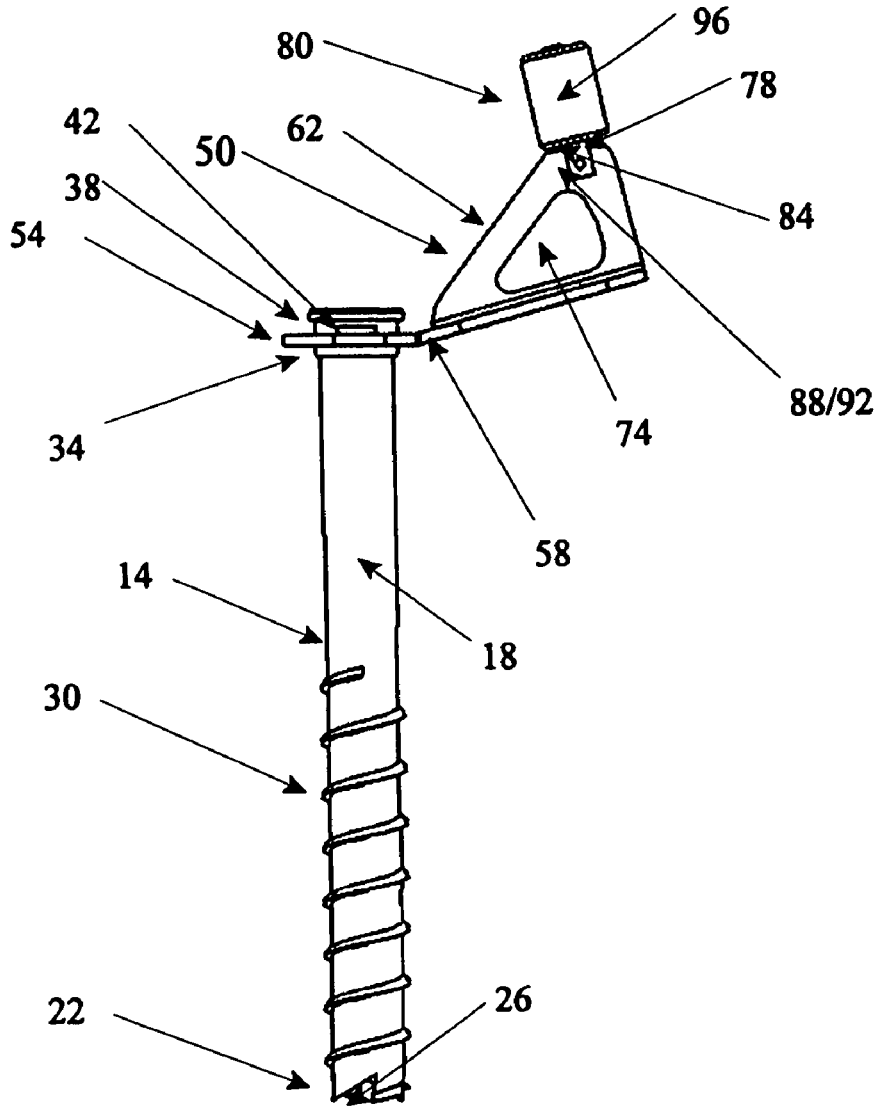
FIG. 4 illustrates a side view of the ice screw illustrated in FIG. 3.

With reference to FIGS. 3 and 4, illustrated is ice screw 10. Ice screw 10 is shown comprising an elongated shaft 14 having a proximate end 18 and a distal end 22. Shaft 14 may vary in length and is preferably hollow to reduce the overall weight of ice screw 10, and to facilitate the penetration of shaft 14 into a body of ice as intended. The inside and outside diameters of shaft 14 are pre-determined, with the wall thickness of shaft 14 varying according to needed strengths.

At distal end 18, shaft 14 comprises a plurality of teeth 26 (preferably strategically cut from shaft 14) that each comprise an appropriate cutting surface or cutting edge. Teeth 26 are the leading elements of ice screw 10 as shaft 14 is initially inserted into a body of ice, and function to cut into the body of ice and assist in the penetration and screwing of shaft 14 into the body of ice. The number, size, shape, and/or cutting surface of each of teeth 26 may vary as will be apparent to one of ordinary skill in the art.

Shaft 14 further comprises external screw threads 30 formed on at least a portion of shaft 14. External screw threads 30 extend along shaft 14 and comprise a predetermined thread pitch, thread depth, as well as predetermined thread spacing. Each of these screw thread characteristics may vary, with the determination of these characteristics depending upon the intended use of ice screw 10, including the condition of the body of ice upon which ice screw 10 is to be used. Any thread design may be utilized with the present invention ice screw.

Shaft 14 further comprises a head member 34 positioned or existing at proximate end 18. Head member 34 further comprises a rim portion 38 that is securely fastened or integrally formed with head member 34 of shaft 14. Head member 34 purposely comprises a larger outside diameter (if also hollow) than the outside diameter of shaft 14 for the purpose of securing shaft 14 to a hanger 50. As shown in FIG. 3, shaft 14 is inserted through aperture 66 formed within coupling portion 54 of hanger 50. Head member 34 further comprises at least one, and preferably a plurality, of flats 42 formed in the curvature of the head 34 that function to receive matching or complimentary flats 70 formed within aperture 66 of coupling portion 54 of hanger 50. Flats 42 of head 34 extend only partially along head 34 so as to provide a lip portion that keeps hanger 50 from sliding down shaft 14 towards distal end 22. Located at the opposing end is rim 38. Rim 38 comprises a larger diameter than head member 34 and functions to keep shaft 14 from sliding out of hanger 50, or rather to keep hanger 50 from sliding off of head member 34. The complimentary mating and structural relationship existing between flats 42 and flats 70 causes any induced rotation of hanger 50 to impart a resultant rotation to shaft 14. This function and purpose is explained in greater detail below. The surface of shaft 14 is preferably formed with a very smooth, mirror-like surface for facilitating insertion and removal from the ice. Such a surface may be obtained by chemical or electrochemical processing methods and treatments.

FIGS. 3 and 4 further illustrate ice screw 10 as comprising a hanger 50. Hanger 50 is attached to shaft 14 and is used for two primary purposes. First, hanger 50 provides one means for transferring force from a user to shaft 14 to insert and screw or drive ice screw 10 into a body of ice. Second, hanger 50 provides means for coupling a carabiner to ice screw 10 once ice screw 10 is securely inserted and screwed into the body of ice to support a user during a climb. As stated above, hanger 50 comprises an aperture 66 through which proximate end 18 of shaft 14 is inserted to attach hanger 50 to shaft 14. Head 34 and rim 38 function to secure hanger 50 to shaft 14, as well as to provide means for facilitating the screwing of ice screw 10 into a body of ice. Aperture 66 includes two opposing flat surfaces or flats 70 formed in the curvature of aperture 66, for mating with the flat surfaces or flats 42 formed in head 34 of shaft 14. Therefore, shaft 14 and hanger 50 must turn together, or, in other words, rotation imparted to hanger 50 causes shaft 14 to also rotate. Preferably, the diameter of aperture 66 is greater than the diameter of shaft 14 or head 34 so that there is play between hanger 50 and shaft 14. The diameter of rim 38 is larger than the diameter of aperture 66, thus preventing hanger 50 from coming off shaft 14. Hanger 50 also has an eye 74 for clipping on a carabiner (not shown).

It should be noted that this particular design (e.g., complimentary flats on each of the head and hanger) used to couple shaft 14 to hanger 50 is merely representative of one exemplary design. Indeed, there are several ways and/or designs that may be used to couple shaft 14 to hanger 50 in a functional manner as will be apparent to one ordinarily skilled in the art.

Hanger 50 is preferably made of a single piece of material bent to form the desired configuration. As illustrated in FIG. 3, hanger 50 is comprises a multiple planar configuration. Preferably, hanger 50 is formed into three planes, as shown, each having their own specific function, which is discussed below.

The first plane consists of a coupling portion or segment 54 that comprises aperture 66 that receives head 34 of shaft 14 as discussed above. Coupling portion 54 is generally perpendicular to the axis of shaft 14. Coupling portion 54 comprises complimentary flats that match the flats on head 34 and that function to secure head 34 in a given position and to prevent head 34 or shaft 14 from turning within aperture 66.

The second plane of hanger 50 consists of a hanger extension 58. Hanger extension 58 is coplanar or substantially coplanar with coupling portion 54. In an exemplary embodiment, shown in FIG. 4, a slight angle is formed between coupling portion 54 and hanger extension 58, as shown. This angle may range between 0 and 20 degrees, depending upon different design constraints. As such, coupling portion 54 and hanger extension 58 may be formed at different angles with respect to one another. Because of the play between hanger 50 and shaft 14, the angle between coupling portion 54 and hanger extension 58 and the axis of shaft 14 may vary significantly.

Hanger extension 58 connects coupling portion 54 to a hanger portion 62. Hanger portion 62 extends from hanger extension 58 in a perpendicular or substantially perpendicular manner making hanger portion 62 substantially perpendicular to both coupling portion 54 and hanger extension 58. It is of coarse understood that hanger 50 may be configured in any number of ways. Hanger extension 58 functions to receive a carabiner within eye 74.

Hanger 50 is preferably made of sheet steel having sufficient thickness and strength so as to support the loads and potential loads experienced during climbing. The general shape of hanger 50, including aperture 66 and eye 74, may be stamped into the steel and then the steel bent into the desired configuration.

FIGS. 3 and 4 further illustrate crank handle 80 as it is positioned on and attached or coupled to hanger 50, and particularly to hanger portion 62. The purpose and function of crank handle 80 is twofold, with the second function being secondary to the first. The primary function of crank handle 80 is to allow or facilitate more efficient screwing or driving of ice screw 10 into a body of ice. This is accomplished by crank handle 80 extending from hanger portion 62, thus providing a more leveraged moment arm that induces a greater rotational force about shaft 14, and particularly a central axis of shaft 14. In addition, crank handle 80 preferably comprises a rotating sleeve 96 that rotates about attachment shaft 84 as the climber is screwing ice screw 10 into the ice. As a crank handle for an ice screw with its primary purpose and function is well known in the art, these particular details are not specifically recited herein. However, unlike prior art crank handles, crank handle 80 of the present invention comprises a new and unique or novel flexing function that is secondary to the primary cranking function.

As discussed above, one of the primary inherent difficulties or problems of ice screw crank handles is that, while providing a significant benefit, they also tend to obstruct and/or interfere with the normal operations and capabilities of the ice screw, particularly when a support structure, such as a carabiner, is attached to the hanger of the ice screw. Stated differently, crank handles obstruct and interfere with the normal operations of the carabiners attached to the hangers of the ice screws—the problem of cross-loading.

In light of this, the present invention features a flexing or breakaway crank handle 80 that still serves its primary function of facilitating more efficient screwing of ice screw 10 into a body of ice, but yet eliminates the loading, or rather cross-loading, problem associated with prior art crank handles, as well as improves on prior art foldable crank handles by making such a design unnecessary.

In one exemplary embodiment, flexing crank handle 80 is a substantially stationary crank handle that comprises a biased component or a flexing member allowing it to flex and move out of the way when loaded. The term substantially stationary shall mean any flexing crank handle that does not require manual manipulation to relocate the crank handle once the cranking process in completed, but that is instead more or less fixed unless caused to flex due to an induced load.

The biasing component or flexing member, with its flexing capabilities, allows the entire crank handle 80 to temporarily move or flex in the direction of the load. The intended function of such a biasing component built into a crank handle is to reduce, and preferably eliminate, the problem of cross-loading of a carabiner without hindering the. primary cranking function of the crank handle or sacrificing the efficiency of the crank handle, and without having to manually adjust or manipulate the crank handle after screwing the ice screw into the ice. In this arrangement, the crank handle is stationary or substantially stationary, only moving or displacing in response to a load, such as an adverse cross-load.

Figure 6:
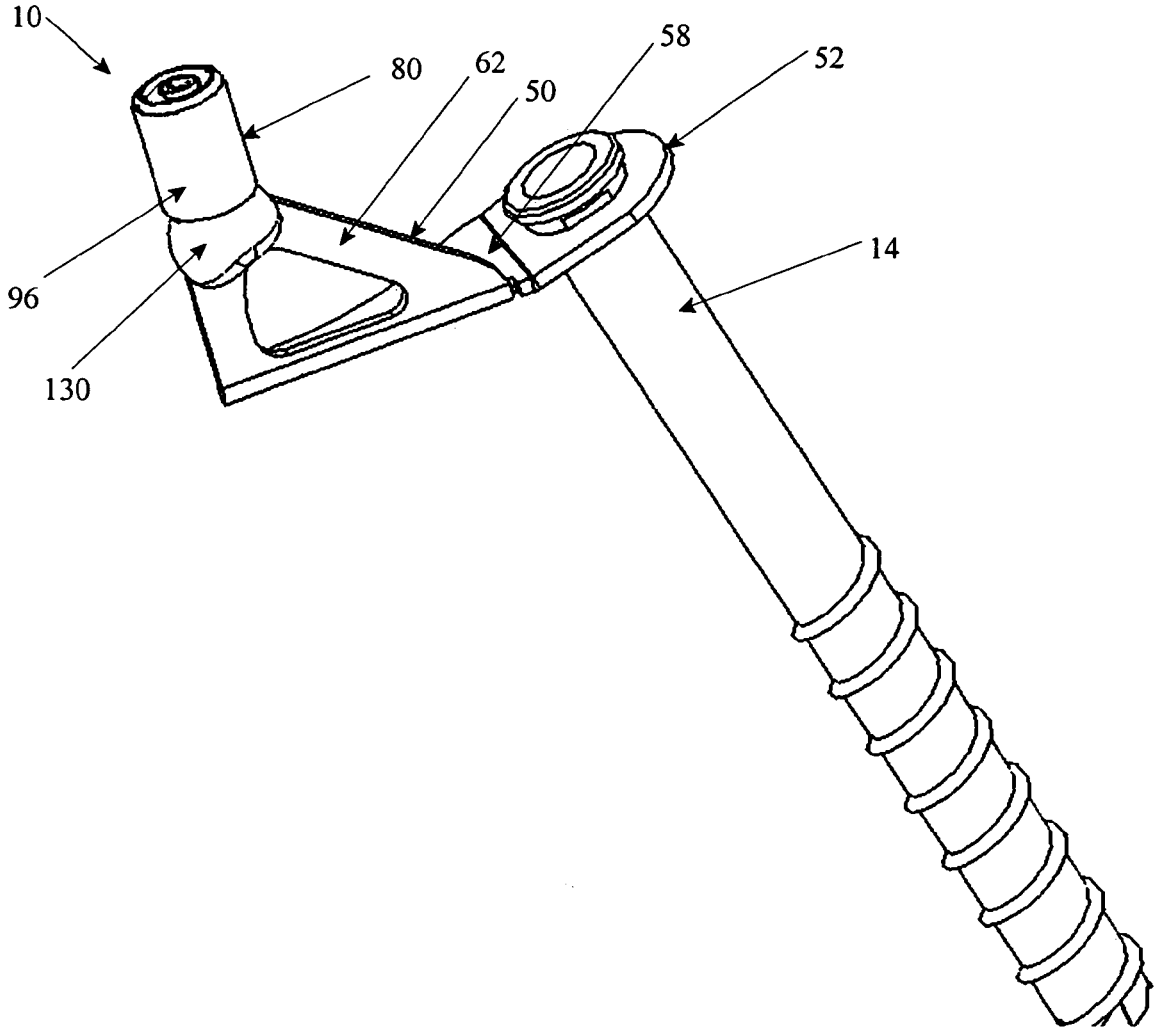
FIG. 6 illustrates a perspective view of another exemplary embodiment of the present invention ice screw, wherein the hanger comprises a semi-spherical knob that provides a multi-vector flex boundary allowing the flexing crank handle to achieve vector flexing.

Flexing crank handle 80 comprises a crank support means that attaches to hanger portion 62 of hanger 50 the crank support means functions to couple the components of flexing crank handle 80 to hanger 50. In the exemplary embodiment shown in FIGS. 3 and 4, flexing crank handle 80, and particularly the crank support means, comprises a rigid shaft 84 that is rotatably coupled to hanger 50 via pivoting pin 88 that pivots in a bi-directional manner about pivot point 92. This allows the entire flexing crank handle structure 80 to move up and down along the flexing boundary (not shown) formed within hanger 50 as intended. However, as shown in FIG. 6, crank support means may also comprise a flexible member that is capable of flexing in any direction. Indeed, any embodiment of flexing crank handle 80 may be made to comprise vector flexing This concept of vector flexing is discussed below. Moreover, flexing crank handle 80 may be made to flex in only a single direction. Indeed, the present invention contemplates any number of flexing vectors, as well as any flexing paths.

Flexing crank handle 80 further comprises a rotating sleeve 96 that fits over the flexing member or crank support means as the climber screws ice screw 10 into the body of ice via flexing crank handle 80. Preferably, sleeve 80 turns or rotates upon a bearing or bushing (not shown) that is also fitted over the flexing member. Rotating sleeve may also function to house and support the flexing or biasing member (not shown) that allows flexing crank handle 80 to flex. One exemplary arrangement of the components of flexing crank handle 80 and their inter-relationship is discussed below.

Referring now to FIG. 5-A, shown is one exemplary embodiment of flexing crank handle 80 in its natural, resting position on hanger 50. This position represents the position of flexing crank handle 80 either just prior to being displaced or flexed in response to a cross-load, or just after a carabiner has freed itself from the flexing crank handle 80. This position also represents the proper cranking position used to crank ice screw 10 and screw it into an ice body.

FIG. 5-B illustrates flexing crank handle 80 in a flexed or displaced position in response to the force F and the direction of force F induced upon flexing crank handle 80 by a carabiner, or other similar support, in a cross-loaded arrangement. As can be seen, flexing crank handle 80 is caused to displace from its resting position about hanger 50. In particular, hanger 50 comprises a flex or flexing boundary 78 formed therein, which is defined herein as the path or boundary that flexing crank handle 80 travels upon any displacement from its resting position. In one exemplary embodiment, this flexing boundary 78 is defined by a portion of the structural shape of hanger 50 at its edge. In the embodiment shown in FIG. 5-B, the edge of hanger portion 62 of hanger 50 comprises a flex boundary 78 having a flat 76 and a curved radius 77. Flexing crank handle 80 specifically tracks along this edge or flexing boundary when being displaced and when returning to its static resting position. In its resting position flexing crank handle 80 is positioned on flat 76. As a cross-load is experienced and as flexing crank handle 80 is caused to displace or flex, it follows along flex boundary 78 from flat 76 to radius 77. The displacement of flexing crank handle 80 continues along flex path 78 until the carabiner is released, at which time flexing crank handle 80 returns to its resting position due to the biasing component existing therein. Although flexing boundary 78 is shown having one particular path and shape, it is contemplated that other paths and shapes are possible to allow flexing crank handle 80 to flex along any desired path or flexing boundary 78.

It is contemplated by the present invention that flexing crank handle 80 may comprise vector positioning or vector flexing. Although in under normal circumstances the flexing of flexing crank handle 80 will occur in a substantially downward motion away from shaft 14, with potentially the addition of some lateral movement or flexing, some embodiments of the present invention provide vector flexing, which allows flexing crank handle 80 to move or flex in any direction with respect to shaft 14. Vector flexing will be advantageous for those climbing situations when an ice screw is screwed into a body of ice in a non-typical or abnormal orientation, whether intentional or inadvertent, or if an ice screw shifts during loading, or in the event of non-linear anchoring as the climb progresses. Other climbing situations not specifically recited herein may also be better served by a crank handle comprising vector flexing. In any event, by designing flexing crank handle 80 to comprise vector flexing, the orientation of ice screw 10, with respect to the direction of load force and potential cross-loading of the carabiner, becomes irrelevant. The carabiner will be able to flex the crank handle in any direction needed to free itself from the crank handle and eliminate any cross-loading of the carabiner and to achieve the most proper operating and oriented position.

FIG. 6 illustrates one exemplary embodiment of an ice screw 10 comprising a flexing crank handle 80 capable of vector positioning. As shown, ice screw 10 comprises a knob 130 attached to or formed within hanger portion 62 of hanger 50 and defining a multi-vector flex boundary. Knob 130 comprises a semi-spherical configuration that allows flexing crank handle 80 to track along its surface in any induced direction as indicated by the three-dimensional axes labeled as x-axis, y-axis and z-axis. The biasing component within flexing crank handle 80 has a sufficient stiffness to allow a climber to crank ice screw 10 using crank handle 80 without undue folding or flexing of crank handle 80 at the various crank positions.

Figure 7:
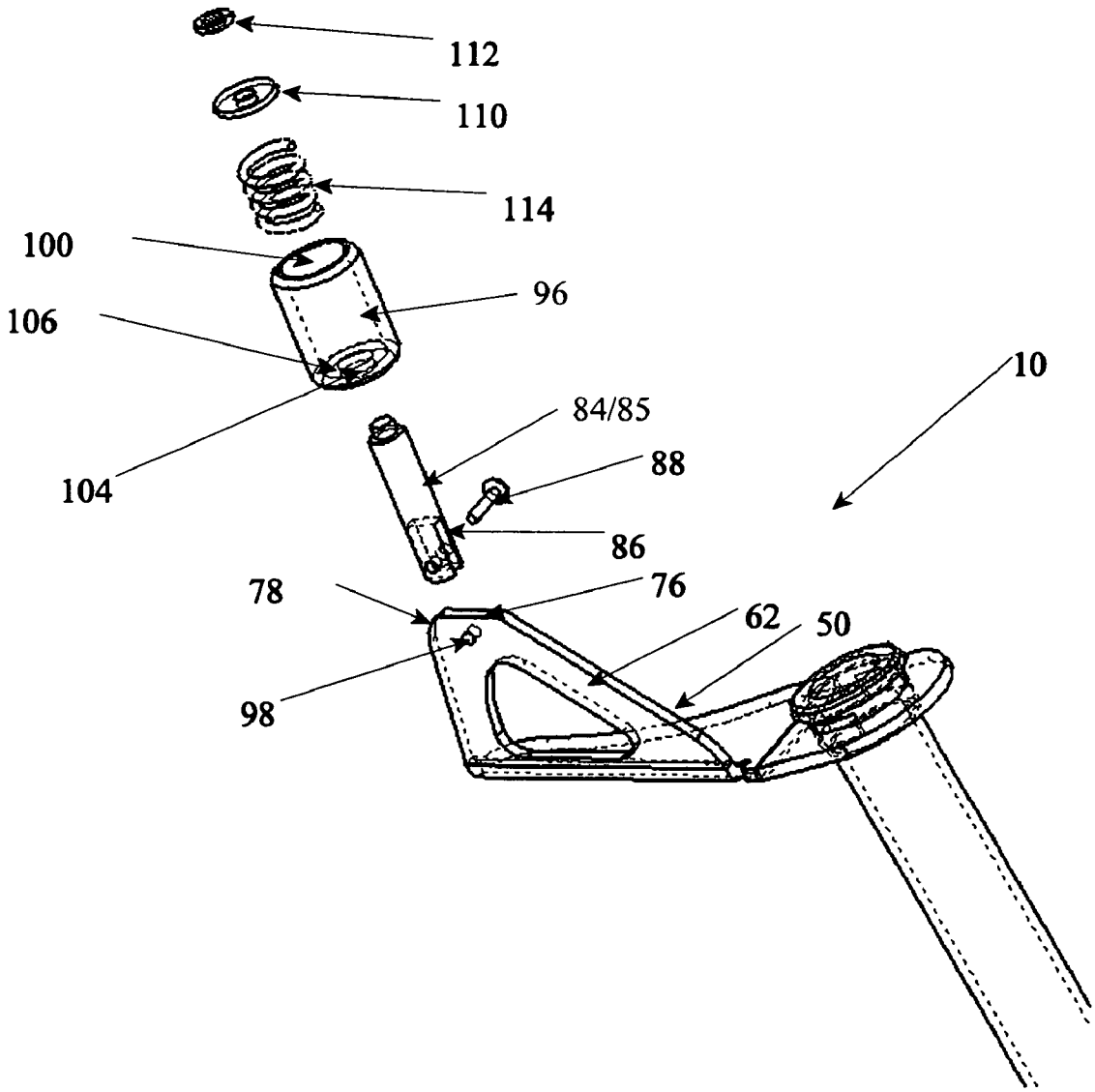
FIG. 7 illustrates a detailed perspective view of the mechanism comprising the flexing crank handle illustrated in FIGS. 1-7.

FIG. 7 illustrates an exploded view of the exemplary flexing crank handle 80 illustrated in each of the preceding Figures. As shown, flexing crank handle 80 comprises a crank support means in the form of a rigid rod 85 that couples to hanger portion 62 of hanger 50. Rigid rod 85 has a slot 86 formed therein that fits over hanger portion 62. Pivot pin 88 is inserted through one end of rod 85 and through aperture 98 in hanger portion 62 and functions to pivotally attach rigid rod 85 to hanger portion 62 so that flexing crank handle 80 may displace or flex in a bidirectional manner about flex boundary 78. Flexing crank handle 80 further comprises a sleeve 96 that is a hollow cylindrical member having a support base 106 at its bottom to support a biasing member 114 therein. Sleeve 96 is preferably a rotating sleeve that fits over rigid rod 85 through aperture 104 formed in support base 106, as shown, and buts up against flat 76 of hanger portion 62. Rigid rod 85 comprises a length that is sufficient to attach to hanger portion 62, extend through sleeve 96, and couple a plunger 114. Plunger 114 functions as an additional support member opposite that of support base 106 for supporting biasing member 114 within sleeve 96 in a compressed manner so as to provide a pre-determined stiffness to flexing crank handle 80. Cap 112 is securely fixed to the opposite end of rigid rod 85 after each component is properly assembled and functions to secure each of the above described elements or components of flexing crank handle 80 together in a coupled relationship.

When flexing crank handle 80 is displaced in response to an induced force, it follows or tracks along flex boundary 78 formed from an edge of hanger 50. As shown, flexing boundary comprises a flat 76 and a radius portion. Of course flex boundary 78 may comprise any desired shape. In this particular embodiment, the distance from pivot point 92 and flat 76 is less than from pivot point 92 to the radius portion of flex boundary 78. Therefore, as flexing crank handle 80 flexes or is caused to flex, or as flexing crank handle approaches and tracks along the radius portion, biasing member 114 is further compressed as plunger 110 is forced to remain the same distance at all times due to the rigid makeup of rod 85 and the fact that plunger 110 is fixed to the end of rod 85. This creates a significant amount of potential energy within flexing crank handle 80, and particularly biasing member 114, that causes flexing crank handle 80 to snap back into its resting position once the induced load is removed (i.e., release of the carabiner from the flexing crank handle).

As shown, this embodiment of flexing crank handle 80 comprises a biasing or flexing member 114 in the form of a spring. Biasing member 114, or the spring shown, comprises a relatively stiff spring constant or stiffness factor and is secured in a compressed state so as to prevent undue folding or flexing of crank handle 80 as a climber uses it to screw the ice screw into a body of ice. However, the spring constant is such that flexing crank handle 80 is still allowed to flex in response to a load placed upon it by a cross-loaded carabiner, thus allowing the carabiner to free itself from flexing crank handle 80 under a given load. As such, the spring constant or stiffness of biasing or flexing member 114 is a pre-determined calculation that depends upon the particular amount of force that is desired to cause flexing crank handle 80 to displace or flex.

The specific mechanism of flexing crank handle 80 shown in FIG. 7, and particularly the various components and their assembly arrangement, is merely one example of a mechanism designed to provide a flexing crank handle. Indeed, one ordinarily skilled in the art will recognize that several other types of mechanisms may exist that will perform the intended function of the present invention, namely, providing a flexing crank handle for an ice screw. As such, the mechanisms or assemblies specifically illustrated and recited or described herein are not meant to be limiting in any way.

Figure 8:
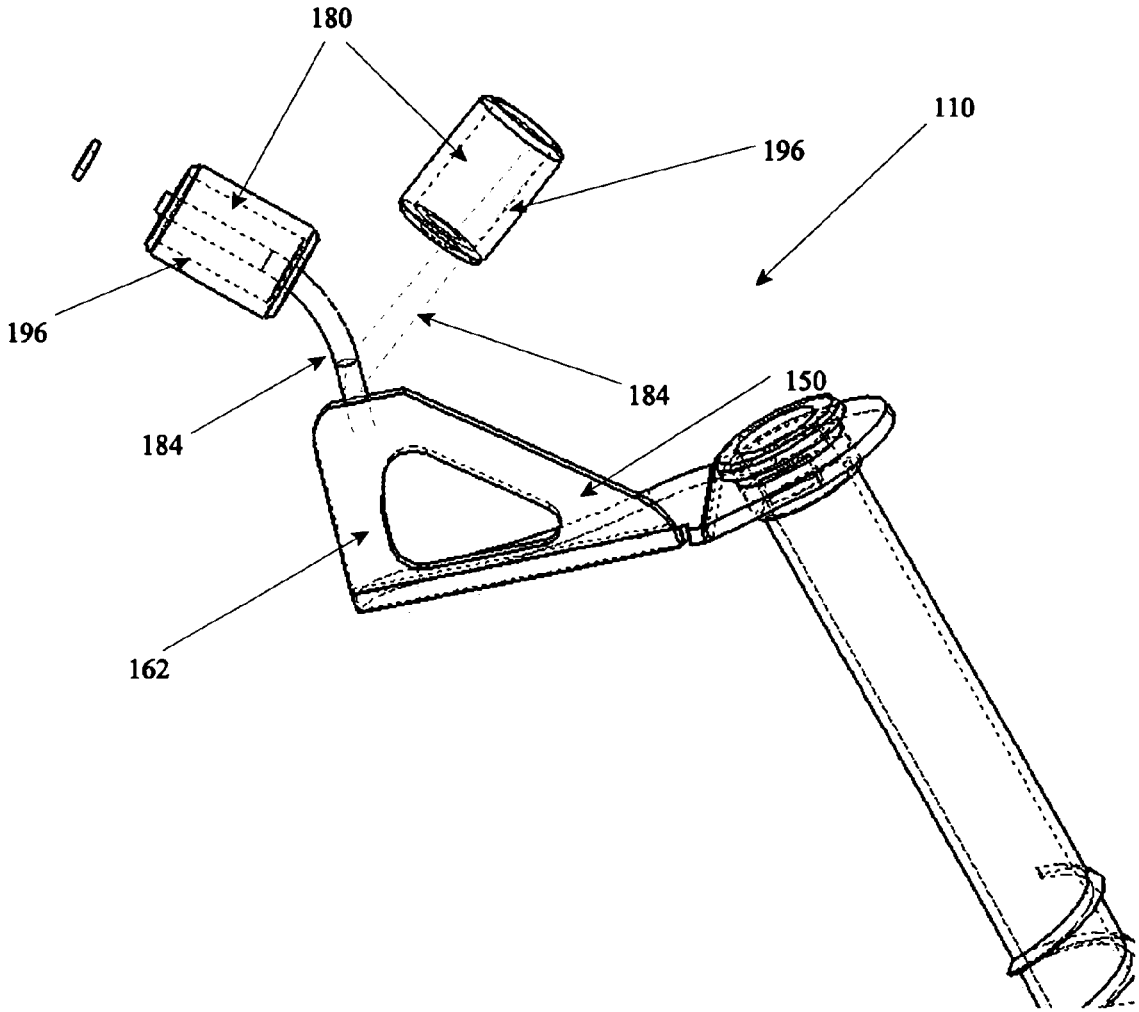
FIG. 8 illustrates another exemplary embodiment of a flexing crank handle, wherein the flexing crank handle comprises a flexible member attached to the hanger allowing the flexing crank handle to flex in any direction without a pre-defined flex boundary.

FIG. 8 illustrates another exemplary embodiment of an ice screw 110 having a flexing crank handle 180. In this embodiment, flexing crank handle 180 comprises a crank support means in the form of a flexible attachment member 184 that is coupled to hanger portion 162 of hanger 150 and extends therefrom a pre-determined distance to optimize the cranking characteristics or abilities of flexing crank handle 180. Attached to the end of flexible attachment member 184 opposite of that used in attachment to hanger 150 is a rotating member 196, thus allowing the user to grasp rotating member 196 and operate the cranking function without letting:go. In this design, there is no need for a biasing component or a flex boundary as described above. Flexing crank handle 180 provides a crank arm by which a climber may screw an ice screw into a body of ice, while still flexing to eliminate cross-loading of a coupled carabiner. In this design there will be significant flexing or folding during the cranking process, but the flexing will be maximized and also maintained at each cranking position as a result of the force necessarily induced by the climber to screw in the ice screw. The direction of applied force during the cranking process may always be kept perpendicular to the shaft of the ice screw, and more easily controlled by the climber. As such, unlike that with crank handles comprising a rigid attachment member, the folding or flexing of crank handle 180 during the cranking process will be negligible and of little effect.

Flexible attachment member 184 may comprise any durable, yet flexible material. In one exemplary embodiment, flexible attachment member 184 may comprise a string, chord, cable, etc. In another embodiment, flexible attachment member 184 may comprise a semi-rigid material, such as nylon or any other similar material.

FIGS. 9-13 illustrate yet other exemplary embodiments of an ice screw having a flexing crank handle comprising a flexing member in several different forms.

FIGS. 9-A and 9-B illustrate alternative exemplary embodiments of a flexing crank handle operable with an ice screw 210. Specifically, FIGS. 9-A and 9-B illustrate flexing crank handle 280 as comprising a flexing member in the form of a spiral spring 214 attached to hanger 262 via attachment points 218 and 230 using known attachment means. Spiral spring 214 further attaches to flexing crank handle 280 and has fitted thereon a sleeve 296. The embodiment shown in the Figures shows coil spring 214 attaching and utilizing a metal sheet 226 for support, wherein the metal sheet is supported within sleeve 296. Of course, coil spring 214 may be attached using other well known methods and devices.

FIGS. 10-A and 10-B illustrate alternative exemplary embodiments of a flexing crank handle operable with an ice screw 310. Specifically, FIGS. 10-A and 10-B illustrate flexing crank handle 380 as comprising a flexing member in the form of complimentary solid height coil springs 214-*a* and 214-*b* attached at one end to opposing sides of hanger 362 as shown. Solid height coil springs 314 are allowed to pivot or flex in any direction as they are attached only at one end. A sleeve may further be provided that fits over and rotates about each of the springs.

FIGS. 11-A and 11-B illustrate alternative exemplary embodiments of a flexing crank handle operable with an ice screw 410. Specifically, FIGS. 11-A and 11-B illustrate flexing crank handle 480 as comprising a flexing member in the form of a wire torsion spring 414 attached to hanger 462 via an aperture 420 formed within hanger 462. Wire torsion spring 414 may further comprise a sleeve 496 supported about wire torsion spring 414 and that functions as discussed above.

FIGS. 12-A and 12-B illustrate alternative exemplary embodiments of a flexing crank handle operable with an ice screw 510. Specifically, FIGS. 12-A and 12-B illustrate flexing crank handle 580 as comprising a flexing member in the form of an internal coil spring 514 contained within sleeve 596 and supported in place via a plunger 516 having a round head thereon. Plunger is also supported within sleeve 596 and follows along a flex boundary located on hanger 562 when flexed. The flex boundary in hanger 562 further comprises a detent 520 that functions to locate flexing crank handle 580 in a resting position. The mechanism shown in these Figures functions much like the mechanism shown in FIGS. 4-7.

FIGS. 13-A and 13-B illustrate alternative exemplary embodiments of a flexing crank handle operable with an ice screw 610. Specifically, FIGS. 13-A and 13-B illustrate flexing crank handle 680 as comprising a flexing member in the form of a compression spring 614 coupled to one side of hanger 662. In this embodiment, rigid rod 620 is attached to hanger 662 at pivot point 624 and functions as a crank support means, wherein on end is used to support a rotating sleeve 696 and the other end is used to contact and compress spring 614 as flexing crank handle 680 is flexed, thus allowing flexing crank handle 680 to move between a resting and flexed position.

From the foregoing Figures and corresponding description it is evident that any type of flexing member is intended for use with an ice screw to provide a flexing crank handle, as applicable. Indeed, one ordinarily skilled in the art will recognize equivalent structures that are not specifically recited herein, but that are within the scope of the invention as described and claimed herein.

It is emphasized that the present invention provides many significant advantages over prior art ice screw and crank handle designs. First, a stiffer biasing member may be used than in prior art designs because the flexing crank handle of the present invention does not require manual manipulation to move it out of the way before proceeding with the climb. This in turn reduces unwanted flexing or folding of the crank handle at various cranking positions when screwing the ice screw into a body of ice. Second, the hanger can be made smaller because no recess is required to allow the crank handle to move out of the way. The present invention flexing crank handle does is not required to be moved out of the way. Third, less material on the hanger means the overall weight of the ice screw is reduced. This is significant considering weight is an important issue in climbing and as a climber may carry anywhere from 15-20 ice screws at once. Fourth, a flexing crank handle capable of vector flexing eliminates cross-loading even in the most non-typical orientations of an inserted ice screw. Fifth, the diameter of the crank handle may be increased because it is not required to fit into a recess once the cranking function is completed. Sixth, various other ergonomically preferred shapes and sizes of crank handle may be utilized. Seventh, the size of the flexing crank handle is large enough to effectively facilitate cranking, yet small enough to reduce the potential for the cranking arm to get caught on clothing or other climbing gear. Eighth, the flexing crank handle allows the repositioning of carabiners, slings, and ropes to the strongest and most optimal position for their intended design.

The advantages immediately recited herein are not meant to be limiting in any way. Indeed, one ordinarily skilled in the art will recognize that other advantages, not specifically recited herein, will be apparent from the design of the present invention as. disclosed, shown, and claimed herein.

The present invention further comprises a method for securing an ice screw to a body of ice, or a method of securing or coupling a carabiner to an ice screw, wherein the method comprises the steps of obtaining an ice screw, the ice screw comprising the elements discussed above; grasping the flexing crank handle and screwing the ice screw into the body of ice; coupling a carabiner to the hanger of the ice screw; and applying a load to the carabiner, such that the flexing crank handle is caused to displace and flex in the event of cross-loading of the carabiner, wherein the flexing function allows the carabiner to disengage and free itself from the flexing crank handle to assume a normal operating or load bearing position, orientation, or arrangement.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An ice screw for use in ice climbing, said ice screw comprising:

a hollow shaft having a plurality of screw threads formed thereon for securing said ice screw to a body of ice;

a hanger coupled to said hollow shaft for receiving a carabiner and supporting a climber; and a flexing crank handle coupled to said hanger and functioning as a crank arm for screwing said ice screw into said body of ice, said flexing crank handle being configured to displace by flex from a resting position to a plurality of flexed positions in response to a load induced thereon, and to automatically return to said resting position without the need for manual manipulation.

2. The ice screw of claim 1, wherein said flexing crank handle comprises a mechanism for facilitating displacement and flexing of said flexing crank handle, said mechanism comprising:

crank support means for attaching said flexing crank handle to said hanger;

a flexing member operable with said crank support means, said flexing member allowing said flexing crank handle to flex and displace in response to an induced load; and a sleeve rotatable about said flexing member.

3. The ice screw of claim 2, wherein said flexing member comprises a compression spring supported within said sleeve and pre-loaded using a plunger attached to said crank support means that fits within said sleeve, said spring having a pre-determined stiffness.

4. The ice screw of claim 2, wherein said flexing member comprises a spiral spring.

5. The ice screw of claim 2, wherein said flexing member comprises complimentary solid height coil springs attached opposite one another on said hanger.

6. The ice screw of claim 2, wherein said flexing member comprises a solid height coil spring attached within a recess formed in said hanger.

7. The ice screw of claim 2, wherein said flexing member comprises a wire torsion spring.

8. The ice screw of claim 2, wherein said flexing member comprises an internal coil spring.

9. The ice screw of claim 2, wherein said crank support means is selected from the group consisting of a rigid rod pivotally attached to said hanger and a flexible material.

10. The ice screw of claim 2, wherein said crank support means comprises a flexing member attached to said hanger, wherein said flexing member is selected from the group consisting of a string, a cable, a semi-rigid material, or any other similar flexing element.

11. The ice screw of claim 1, wherein said hanger further comprises a flex boundary that dictates the flex path of said flexing crank handle and supports said flexing crank handle in said resting and said plurality of flexed positions.

12. The ice screw of claim 11, wherein said flex boundary of said hanger comprises a flat and a radius portion for supporting said flexing crank handle in said resting, cranking position and said plurality of flexed positions, respectively.

13. The ice screw of claim 11, wherein said flex boundary comprises support surfaces of varying pre-determined distances from an attachment point of said flexing crank handle on said hanger, such that as said flexing crank handle follows along said support surfaces of said flex boundary from said resting position to one or more of said flexed positions, said flexing crank handle increases in potential energy, thus causing said flexing crank handle to snap back to its said resting position when said load is removed.

14. The ice screw of claim 12, wherein said radius portion is positioned an identified, pre-determined distance from a pivot point on said hanger, and wherein said flat is also positioned an identified, pre-determined distance from a pivot point on said hanger, said distance of said radius portion being greater than said flat by a pre-determined amount, thus causing said flexing crank handle to increase in potential energy as it moves along said flex boundary so that when said load is removed, said flexing crank handle springs back into its said resting position.

15. The ice screw of claim 2, wherein said sleeve is a rotating sleeve that rotates about said flexing member.

16. The ice screw of claim 1, wherein said flexing crank handle reduces cross-loading of an attached carabiner by flexing to allow said carabiner to become disengaged and free itself from said flexing crank handle once said carabiner is loaded.

17. The ice screw of claim 1, wherein said flexing crank handle comprises bi-directional flexing.

18. The ice screw of claim 1, wherein said flexing crank handle comprises vector flexing.

19. The ice screw of claim 11, wherein said flex boundary is a multi-vector flex boundary defined by a knob coupled to said hanger, wherein said knob has a semi-spherical surface shape allowing said flexing crank handle to flex in any direction about said surface to achieve vector flexing.

20. The ice screw of claim 15, wherein said rotating sleeve rotates about a friction-reducing member selected from the group consisting of a bearing, a bushing, and any other similarly functioning device.

21. A flexing crank handle for use with an ice screw, said flexing crank handle comprising a hanger for driving said ice screw:

crank support means for attaching said flexing crank handle to said hanger of said ice screw;

a flexing member operable with said crank support means and configured to enable said flexing crank handle to displace by flex in response to an induced load, and to automatically return to said resting position without the need for manual manipulation; and a sleeve coupled to said flexing member at an end opposite that attached to said hanger.

22. The flexing crank handle of claim 21, wherein said sleeve is a rotating sleeve.

23. The flexing crank handle of claim 21, wherein said crank support means is a flexible member.

24. The flexing crank handle of claim 21, wherein said crank support means comprises a rigid rod that pivotally attaches to said hanger.

25. The flexing crank handle of claim 21, wherein said flexing member comprises a compression spring.

26. The flexing crank handle of claim 21, wherein said flexing member comprises a spiral spring.

27. The flexing crank handle of claim 21, wherein said flexing member comprises complimentary solid height coil springs attached opposite one another on said hanger.

28. The flexing crank handle of claim 21, wherein said flexing member comprises a single solid height coil spring attached within a recess formed in said hanger.

29. The flexing crank handle of claim 21, wherein said flexing member comprises a wire torsion spring.

30. The flexing crank handle of claim 21, wherein said flexing member comprises an internal coil spring.

31. The flexing crank handle of claim 21, wherein said flexing member comprises a compression spring having a pre-determined stiffness and that is supported on at one end by said sleeve, and a plunger for supporting said spring in a pre-loaded condition, said plunger attached to said rigid rod and fitting within said sleeve, said flexing crank handle comprising a resting position and a plurality of flex positions defined as said flexing crank progresses about a designated and pre-determined flex boundary defined by said hanger.

32. A method for correcting existing and potential cross-loading of a carabiner coupled to an ice screw inserted into a body of ice, said method comprising the steps of:

obtaining an ice screw, said ice screw comprising:

a hollow shaft having a plurality of screw threads formed thereon for securing said ice screw to a body of ice;

a hanger coupled to said hollow shaft for receiving a carabiner and supporting a climber;

a flexing crank handle coupled to said hanger in a substantially stationary manner, said flexing crank handle functioning as a crank arm for screwing said ice screw into said body of ice, said flexing crank handle being configured to displace by flex from a resting position to a plurality of flexed positions in response to a load induced thereon, and to automatically return to said resting position without the need for manual manipulation;

grasping said flexing crank handle and screwing said ice screw into said body of ice; and coupling a carabiner to said hanger, wherein said carabiner, in the event of cross-loading, causes said flexing crank handle to flex to allow said carabiner to disengage and free itself from said flexing crank handle and to assume a normal operating orientation.

* * * * *